US011619888B2

(12) United States Patent
Ishiduka et al.

(10) Patent No.: US 11,619,888 B2
(45) Date of Patent: Apr. 4, 2023

(54) ELECTROPHOTOGRAPHIC IMAGE FORMING APPARATUS AND PROCESS CARTRIDGE

(71) Applicant: CANON KABUSHIKI KAISHA, Tokyo (JP)

(72) Inventors: Yuka Ishiduka, Shizuoka (JP); Tsutomu Nishida, Shizuoka (JP); Tatsuya Ohsawa, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/681,580

(22) Filed: Feb. 25, 2022

(65) Prior Publication Data

US 2022/0276580 A1 Sep. 1, 2022

(30) Foreign Application Priority Data

Mar. 1, 2021 (JP) ..... JP2021-032148

(51) Int. Cl.

| | |
|---|---|
| ***G03G 5/147*** | (2006.01) |
| ***G03G 15/00*** | (2006.01) |
| ***G03G 21/16*** | (2006.01) |
| ***G03G 21/18*** | (2006.01) |

(52) U.S. Cl.

CPC ..... *G03G 5/14791* (2013.01); *G03G 15/752* (2013.01); *G03G 21/1666* (2013.01); *G03G 21/1676* (2013.01); *G03G 21/1814* (2013.01)

(58) Field of Classification Search

CPC ..... G03G 5/14791; G03G 15/751; G03G 15/752; G03G 21/1666; G03G 21/1676; G03G 21/1814

See application file for complete search history.

(56) References Cited

U.S. PATENT DOCUMENTS

| | | | | |
|---|---|---|---|---|
| 2008/0261131 | A1* | 10/2008 | Nakayama ..... | G03G 9/09783 430/48 |
| 2015/0185642 | A1 | 7/2015 | Bellino et al. | |
| 2019/0265603 | A1* | 8/2019 | Shimozawa ..... | G03G 5/14791 |
| 2020/0292949 | A1* | 9/2020 | Ishiduka ..... | G03G 5/14791 |

FOREIGN PATENT DOCUMENTS

| | | | |
|---|---|---|---|
| JP | 2004287371 | A | 10/2004 |
| JP | 2020003072 | A | 1/2020 |

* cited by examiner

*Primary Examiner* — Sophia S Chen

(74) *Attorney, Agent, or Firm* — Canon U.S.A., Inc., IP Division

(57) ABSTRACT

An electrophotographic image forming apparatus in which streak-like banding to be formed in an electrophotographic photosensitive member is suppressed. The electrophotographic image forming apparatus includes an electrophotographic photosensitive member, which has a protective layer, and a developer carrying member for supplying a developer. The protective layer contains a cured product containing an aromatic ring and an ester group, by attenuated total reflection Fourier transform infrared spectroscopy, when a peak area based on C═C stretching vibration of the aromatic ring is represented by S1, and a peak area based on C═O stretching vibration of the ester group is represented by S2, an area ratio S1/S2 is 0.10 to 0.27, and a rotation speed ratio D1/D2 of a rotation speed D1 of the developer carrying member to a rotation speed D2 of the electrophotographic photosensitive member is 0.80 to 1.20.

8 Claims, 1 Drawing Sheet

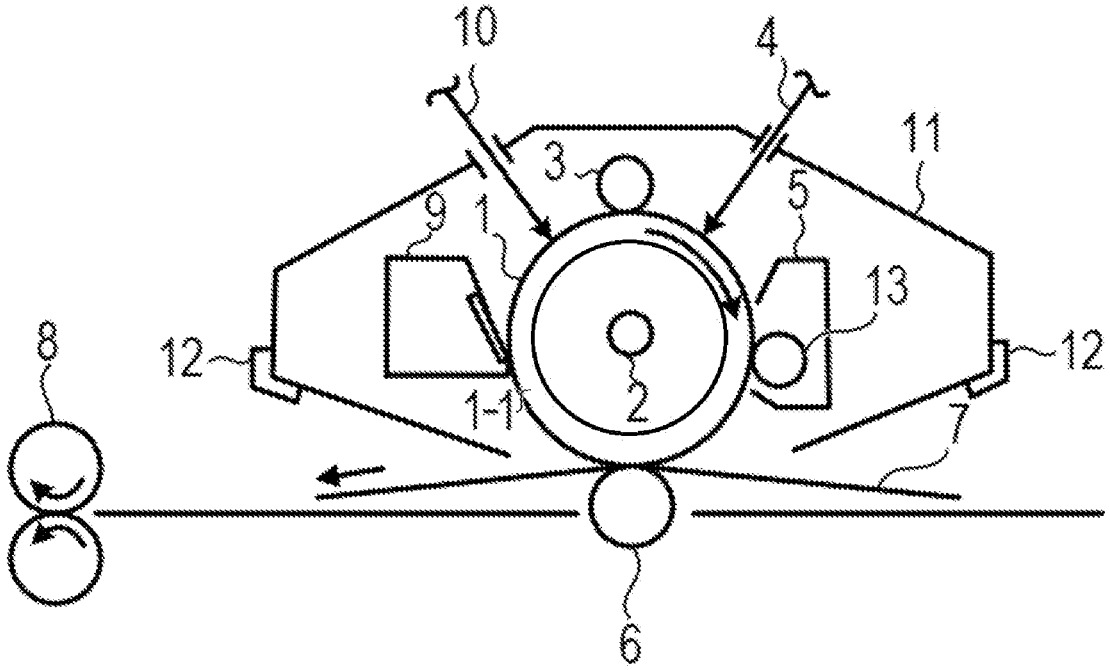
10
4
11
3
5
9
1
13
8
12
12
2
1-1
7
6

ELECTROPHOTOGRAPHIC IMAGE FORMING APPARATUS AND PROCESS CARTRIDGE

BACKGROUND OF THE INVENTION

Field of the Invention

The present disclosure relates to an electrophotographic image forming apparatus and a process cartridge.

Description of the Related Art

A wide variety of investigations have heretofore been made on an electrophotographic photosensitive member to be mounted on an electrophotographic image forming apparatus (hereinafter sometimes referred to as "electrophotographic apparatus") in order to improve image quality and durability. An example thereof is an investigation in which a polymer of a radically polymerizable monomer having an acryloyloxy group or a methacryloyloxy group is used on a surface of the electrophotographic photosensitive member (hereinafter sometimes simply referred to as "photosensitive member") to improve wear resistance (mechanical durability). However, when the polymer of the radically polymerizable monomer is used, although the wear resistance is enhanced, a streak-like image defect may occur. Specifically, a large number of streak-like image defects occur in an image in the same direction as a long-axis direction of the photosensitive member.

In U.S. Patent Application Publication No. 2015/185642, there is a description of a technology for improving the wear resistance of the photosensitive member by forming a protective layer obtained by polymerizing a monomer having an acryloyloxy group with a triarylamine structure and a monomer having an acryloyloxy group without a triarylamine structure. In addition, in Japanese Patent Application Laid-Open No. 2020-3072, regarding so-called banding, which is streak-like unevenness in the same direction as the long-axis direction of the photosensitive member, distortion and vibration generated in a meshing period of a gear are suppressed to minimize the position fluctuation caused by the distortion and vibration in an image forming portion, to thereby suppress the occurrence of banding. In addition, in Japanese Patent Application Laid-Open No. 2004-287371, there is a description of a technology for suppressing the occurrence of banding by incorporating a triarylamine compound having a specific alkylamino group into a surface layer of the photosensitive member and limiting the thickness thereof.

In a developer carrying member and a photosensitive member, when the distance between the developer carrying member and the photosensitive member and the rotation speed of each of the developer carrying member and the photosensitive member are changed due to the influence of the distortion and vibration in an image forming portion, the magnitude of rubbing received by a developer present between the developer carrying member and the surface layer of the photosensitive member is changed. As a result of a change in charge amount of the developer caused by the change in magnitude of rubbing, the amount of the developer transferred to the surface of the photosensitive member becomes uneven, and banding occurs, with the result that streak-like unevenness occurs in an image.

SUMMARY OF THE INVENTION

However, the inventors of the present disclosure have found that, even when the distortion and vibration in the image forming portion are minimized, the occurrence of banding may not be suppressed.

In view of the foregoing, the inventors of the present disclosure have focused on the relationship between the composition of the protective layer serving as the surface layer of the photosensitive member and the peripheral speed difference between the developer carrying member and the surface layer of the photosensitive member, and as a result, have found that there is a configuration in which banding is relieved, to thereby complete the present disclosure.

An aspect of the present disclosure is to provide an electrophotographic image forming apparatus and/or a process cartridge in which the occurrence of banding is suppressed.

The aspect is achieved by the present disclosure described below. That is, according to a first embodiment of the present disclosure, there is provided an electrophotographic image forming apparatus comprising: an electrophotographic photosensitive member, which is rotatable and comprises a protective layer serving as a surface layer; a charging unit configured to form a charging portion in contact with the electrophotographic photosensitive member, and to charge a surface of the electrophotographic photosensitive member in the charging portion; an exposing unit configured to irradiate the surface of the electrophotographic photosensitive member with exposure light; and a developer carrying member configured to supply a developer which is charged to the surface of the electrophotographic photosensitive member, wherein the protective layer contains a cured product of a composition containing a monomer having a polymerizable functional group, and the cured product contains at least an aromatic ring and an ester group, in a peak area of a spectrum of the surface of the electrophotographic photosensitive member obtained through measurement by attenuated total reflection Fourier transform infrared spectroscopy using germanium as an internal reflection element and a measurement condition of 45° as an incident angle, when a peak area at from 1,530 $cm^{-1}$ to 1,470 $cm^{-1}$ based on C═C stretching vibration of the aromatic ring is represented by S1, and a peak area at from 1,770 $cm^{-1}$ to 1,700 $cm^{-1}$ based on C═O stretching vibration of the ester group is represented by S2, an area ratio S1/S2 of the S1 to the S2 is 0.10 to 0.27, and a rotation speed ratio D1/D2 of a rotation speed D1 of the developer carrying member to a rotation speed D2 of the electrophotographic photosensitive member is 0.80 to 1.20.

In addition, according to a second embodiment of the present disclosure, there is provided a process cartridge comprising: an electrophotographic photosensitive member, which is rotatable and comprises a protective layer serving as a surface layer, and a developer carrying member configured to supply a developer which is charged to the surface of the electrophotographic photosensitive member; and at least one unit selected from the group consisting of: a charging unit configured to form a charging portion in contact with the electrophotographic photosensitive member, and to charge the surface in the charging portion; and a cleaning unit configured to clean the surface, the process cartridge integrally supporting the electrophotographic photosensitive member, the developer carrying member, and the at least one unit, and being removably mounted onto a main body of an electrophotographic apparatus, wherein the protective layer contains a cured product of a composition containing a monomer having a polymerizable functional group, and the cured product contains at least an aromatic ring and an ester group, in a peak area of a spectrum of the surface of the electrophotographic photosensitive member obtained through measurement by attenuated total reflection Fourier transform infrared spectroscopy using germanium as an internal reflection element and a measurement condition of 45° as an incident angle, when a peak area at from 1,530 $cm^{-1}$ to 1,470 $cm^{-1}$ based on C═C stretching vibration of the aromatic ring is represented by S1, and a peak area at from 1,770 $cm^{-1}$ to 1,700 $cm^{-1}$ based on C═O stretching vibration of the ester group is represented by S2, an area ratio S1/S2 of the S1 to the S2 is 0.10 to 0.27, and wherein the developer carrying member and the electrophotographic photosensitive member are configured so that a rotation speed ratio D1/D2 of a rotation speed D1 of the developer carrying member to a rotation speed D2 of the electrophotographic photosensitive member satisfies 0.80 to 1.20.

According to the present disclosure, the electrophotographic image forming apparatus and/or the process cartridge in which the occurrence of banding is suppressed for a long period of time can be provided.

Further features of the present disclosure will become apparent from the following description of exemplary embodiments with reference to the attached drawing.

BRIEF DESCRIPTION OF THE DRAWINGS

FIGURE is a view for illustrating an example of each schematic configuration of an electrophotographic apparatus and a process cartridge of the present disclosure.

DESCRIPTION OF THE EMBODIMENTS

Now, the present disclosure is described in detail by way of an exemplary embodiment. As used herein, the term "(meth)acryloyloxy group" means an acryloyloxy group and/or a methacryloyloxy group.

The inventors of the present disclosure presume the suppressive effect on the occurrence of banding by an electrophotographic image forming apparatus and/or a process cartridge of the present disclosure to be as described below.

As a factor for increasing the occurrence of banding, there is given the amount of an ester group with respect to an aromatic ring on the surface of a photosensitive member. The following is conceived. In the case where the proportion of the ester group to the aromatic ring is large on the surface of the photosensitive member, when a developer is rubbed between a developer carrying member and the photosensitive member, a large amount of charge is transferred from the ester group to a toner contained in the developer, and the magnitude of rubbing is changed, the carried amount of the toner from the developer carrying member to the surface of the photosensitive member is influenced. Because of this, it is conceived that the difference in amount of a toner carried on the surface of the photosensitive member causes streak-like shading, that is, banding in the image.

Accordingly, in the present disclosure, the amount of the ester group with respect to the aromatic ring on the surface of the electrophotographic photosensitive member is set so that, in a peak area of a spectrum obtained through measurement by attenuated total reflection Fourier transform infrared spectroscopy using germanium as an internal reflection element and a measurement condition of 45° as an incident angle, when a peak area at from 1,530 $cm^{-1}$ to 1,470 $cm^{-1}$ based on C═C stretching vibration of the aromatic ring is represented by S1, and a peak area at from 1,770 $cm^{-1}$ to 1,700 $cm^{-1}$ based on C═O stretching vibration of the ester group is represented by S2, an area ratio S1/S2 of the S1 to the S2 is 0.10 to 0.27.

In addition, when the area ratio S1/S2 falls within the above-mentioned range, and a rotation speed ratio D1/D2 of a rotation speed D1 of the developer carrying member to a rotation speed D2 of the electrophotographic photosensitive member is 0.80 to 1.20, the occurrence of banding can be sufficiently suppressed.

The aromatic ring is less likely to transfer charge to a toner, as compared to the ester group. When the area ratio S1/S2 is smaller than 0.10, the ester group is relatively abundant with respect to the aromatic ring, and hence the occurrence of banding cannot be sufficiently suppressed.

The ester group is more likely to absorb external vibration and impact, as compared to the aromatic ring. When the area ratio S1/S2 is larger than 0.27, the content of the ester group forming the surface layer that absorbs external vibration and impact more easily becomes relatively smaller than the content of the aromatic ring. As a result, the vibration and impact of part of an image forming portion cannot be absorbed, and the occurrence of banding cannot be sufficiently suppressed. It is preferred that the area ratio S1/S2 fall within the range of 0.14 to 0.17 because the occurrence of banding is further suppressed.

When the rotation speed ratio D1/D2 of the present disclosure is smaller than 0.80, the rubbing force of a toner between the developer carrying member and the photosensitive member is increased, and the transfer of charge from the surface of the protective layer to the toner is increased. Accordingly, the chargeability of the photosensitive member is lowered, and an image may have fogging as well as banding during solid white printing. When the rotation speed ratio D1/D2 is larger than 1.20, fogging occurs in a printed image during solid white printing as in the case where the rotation speed ratio D1/D2 is smaller than 0.80. In addition, the occurrence of banding is further increased. The reason for this is conceived as described below. The rotation speed D1 of the developer carrying member becomes relatively faster than the rotation speed D2 of the photosensitive member, with the result that the vibration and the rotation deflection in the image forming portion become large. It is preferred that the rotation speed ratio D1/D2 be 0.80 to 0.95 because the occurrence of banding is further suppressed.

The suppressive effect on the occurrence of banding of the present disclosure can be obtained even when the process speed is high. For example, when the process speed is 60 sheets per min or more, distortion and vibration in the image forming portion become large, and hence it has hitherto been considered that the occurrence of banding cannot be suppressed. However, in the configuration of the present disclosure, even when the process speed is 60 sheets per min or more, an image in which the occurrence of banding is suppressed can be obtained as in the case of using an electrophotographic image forming apparatus and/or a process cartridge having a process speed slower than 60 sheets per min.

An investigation has been made also on the toner side in order to suppress the transfer of charge from the photosensitive member to the toner. However, although the suppressive effect on the occurrence of banding is obtained depending on the type of an external additive of the toner, an effect that influences the suppressive effect on the occurrence of banding obtained from the configuration of the present disclosure cannot be obtained.

[Electrophotographic Photosensitive Member]

The electrophotographic photosensitive member includes a support, a photosensitive layer formed on the support, and a protective layer serving as a surface layer formed on the photosensitive layer.

A method of producing the electrophotographic photosensitive member is, for example, a method involving: preparing coating liquids for the respective layers to be described later; applying the liquids in a desired order of the layers; and drying the liquids. In this case, examples of the method of applying the coating liquid include dip coating, spray coating, inkjet coating, roll coating, die coating, blade coating, curtain coating, wire bar coating, and ring coating. Of those, dip coating is preferred from the viewpoints of efficiency and productivity.

Now, the support and the respective layers are described.

<Support>

The support is preferably a conductive support having conductivity. In addition, examples of the shape of the support include a cylindrical shape, a belt shape, and a sheet shape. Of those, a cylindrical support is preferred. In addition, the outer surface of the support may be subjected to, for example, electrochemical treatment such as anodization to form an oxide film, blast treatment, or cutting treatment. A metal, a resin, glass, or the like is preferred as a material for the support.

Examples of the metal include aluminum, iron, nickel, copper, gold, stainless steel, and alloys thereof. The support is preferably an aluminum support using aluminum out of those metals. The support is more preferably an aluminum alloy having an oxide film on an outer surface thereof. The presence of the oxide film can suppress the injection of charge from the support, and hence the suppressive effect on the occurrence of the black spot under a high-humidity environment is increased.

In addition, conductivity may be imparted to the resin or the glass through treatment involving, for example, mixing or coating the resin or the glass with a conductive material.

<Conductive Layer>

The conductive layer may be formed on the support. The formation of the conductive layer can conceal flaws and unevenness in the surface of the support, and control the reflection of light on the surface of the support.

It is preferred that the conductive layer contain conductive particles and a resin.

A material for the conductive particles is, for example, a metal oxide, a metal, or carbon black.

Examples of the metal oxide include zinc oxide, aluminum oxide, indium oxide, silicon oxide, zirconium oxide, tin oxide, titanium oxide, magnesium oxide, antimony oxide, and bismuth oxide. Examples of the metal include aluminum, nickel, iron, nichrome, copper, zinc, and silver.

Of those, a metal oxide is preferably used as the conductive particles, and in particular, titanium oxide, tin oxide, and zinc oxide are more preferably used.

When the metal oxide is used as the conductive particles, the surface of the metal oxide may be treated with a silane coupling agent or the like, or the metal oxide may be doped with an element such as phosphorus or aluminum or an oxide thereof.

In addition, each of the conductive particles may be of a laminated construction having a core particle and a coating layer coating the particle. Examples of the core particle include titanium oxide, barium sulfate, and zinc oxide. The coating layer is, for example, a metal oxide such as tin oxide.

In addition, when the metal oxide is used as the conductive particles, their volume-average particle diameter is preferably 1 nm or more and 500 nm or less, more preferably 3 nm or more and 400 nm or less.

Examples of the resin include a polyester resin, a polycarbonate resin, a polyvinyl acetal resin, an acrylic resin, a silicone resin, an epoxy resin, a melamine resin, a polyurethane resin, a phenol resin, and an alkyd resin.

In addition, the conductive layer may further contain a concealing agent such as a silicone oil, resin particles, or titanium oxide.

The conductive layer has an average thickness of preferably 1 μm or more and 50 μm or less, particularly preferably 3 μm or more and 40 μm or less.

The conductive layer may be formed by preparing a coating liquid for a conductive layer containing the above-mentioned materials and a solvent, forming a coat thereof, and drying the coat. Examples of the solvent to be used for the coating liquid include an alcohol-based solvent, a sulfoxide-based solvent, a ketone-based solvent, an ether-based solvent, an ester-based solvent, and an aromatic hydrocarbon-based solvent. As a dispersion method for dispersing the conductive particles in the coating liquid for a conductive layer, there are given methods using a paint shaker, a sand mill, a ball mill, and a liquid collision-type high-speed disperser.

<Undercoat Layer>

The undercoat layer may be formed on the support or the conductive layer. The formation of the undercoat layer can improve an adhesive function between layers to impart a charge injection-inhibiting function.

It is preferred that the undercoat layer contain a resin. In addition, the undercoat layer may be formed as a cured film by polymerizing a composition containing a monomer having a polymerizable functional group.

Examples of the resin include a polyester resin, a polycarbonate resin, a polyvinyl acetal resin, an acrylic resin, an epoxy resin, a melamine resin, a polyurethane resin, a phenol resin, a polyvinyl phenol resin, an alkyd resin, a polyvinyl alcohol resin, a polyethylene oxide resin, a polypropylene oxide resin, a polyamide resin, a polyamic acid resin, a polyimide resin, a polyamide imide resin, and a cellulose resin.

Examples of the polymerizable functional group of the monomer having a polymerizable functional group include an isocyanate group, a blocked isocyanate group, a methylol group, an alkylated methylol group, an epoxy group, a metal alkoxide group, a hydroxyl group, an amino group, a carboxyl group, a thiol group, a carboxylic acid anhydride group, and a carbon-carbon double bond group.

In addition, the undercoat layer may further contain an electron-transporting substance, a metal oxide, a metal, a conductive polymer, and the like for the purpose of improving electric characteristics. Of those, an electron-transporting substance and a metal oxide are preferably used.

Examples of the electron-transporting substance include a quinone compound, an imide compound, a benzimidazole compound, a cyclopentadienylidene compound, a fluorenone compound, a xanthone compound, a benzophenone compound, a cyanovinyl compound, a halogenated aryl compound, a silole compound, and a boron-containing compound. An electron-transporting substance having a polymerizable functional group may be used as the electron-transporting substance and copolymerized with the above-mentioned monomer having a polymerizable functional group to form the undercoat layer as a cured film.

Examples of the metal oxide include indium tin oxide, tin oxide, indium oxide, titanium oxide, zinc oxide, aluminum oxide, and silicon dioxide. Examples of the metal include gold, silver, and aluminum.

In addition, the undercoat layer may further contain an additive.

The undercoat layer has an average thickness of preferably 0.1 μm or more and 50 μm or less, more preferably 0.2 μm or more and 40 μm or less, particularly preferably 0.3 μm or more and 30 μm or less.

The undercoat layer may be formed by preparing a coating liquid for an undercoat layer containing the above-mentioned materials and a solvent, forming a coat thereof, and drying and/or curing the coat. Examples of the solvent to be used for the coating liquid include an alcohol-based solvent, a ketone-based solvent, an ether-based solvent, an ester-based solvent, and an aromatic hydrocarbon-based solvent.

<Photosensitive Layer>

The photosensitive layers of electrophotographic photosensitive members are mainly classified into (1) a laminate type photosensitive layer and (2) a monolayer type photosensitive layer. (1) The laminate type photosensitive layer has a charge-generating layer containing a charge-generating substance and a charge-transporting layer containing a charge-transporting substance. (2) The monolayer type photosensitive layer has a photosensitive layer containing both a charge-generating substance and a charge-transporting substance.

(1) Laminate Type Photosensitive Layer

The laminate type photosensitive layer has the charge-generating layer and the charge-transporting layer.

(1-1) Charge-Generating Layer

It is preferred that the charge-generating layer contain the charge-generating substance and a resin.

Examples of the charge-generating substance include azo pigments, perylene pigments, polycyclic quinone pigments, indigo pigments, and phthalocyanine pigments. Of those, azo pigments and phthalocyanine pigments are preferred. Of the phthalocyanine pigments, an oxytitanium phthalocyanine pigment, a chlorogallium phthalocyanine pigment, and a hydroxygallium phthalocyanine pigment are preferred.

The content of the charge-generating substance in the charge-generating layer is preferably 40 mass % or more and 85 mass % or less, more preferably 60 mass % or more and 80 mass % or less with respect to the total mass of the charge-generating layer.

Examples of the resin include a polyester resin, a polycarbonate resin, a polyvinyl acetal resin, a polyvinyl butyral resin, an acrylic resin, a silicone resin, an epoxy resin, a melamine resin, a polyurethane resin, a phenol resin, a polyvinyl alcohol resin, a cellulose resin, a polystyrene resin, a polyvinyl acetate resin, and a polyvinyl chloride resin. Of those, a polyvinyl butyral resin is more preferred.

In addition, the charge-generating layer may further contain an additive such as an antioxidant or a UV absorber. Specific examples thereof include a hindered phenol compound, a hindered amine compound, a sulfur compound, a phosphorus compound, and a benzophenone compound.

The charge-generating layer has an average thickness of preferably 0.1 μm or more and 1 μm or less, more preferably 0.15 μm or more and 0.4 μm or less.

The charge-generating layer may be formed by preparing a coating liquid for a charge-generating layer containing the above-mentioned materials and a solvent, forming a coat thereof, and drying the coat. Examples of the solvent to be used for the coating liquid include an alcohol-based solvent, a sulfoxide-based solvent, a ketone-based solvent, an ether-based solvent, an ester-based solvent, and an aromatic hydrocarbon-based solvent.

(1-2) Charge-Transporting Layer

It is preferred that the charge-transporting layer contain the charge-transporting substance and a resin.

Examples of the charge-transporting substance include a polycyclic aromatic compound, a heterocyclic compound, a hydrazone compound, a styryl compound, an enamine compound, a benzidine compound, a triarylamine compound, and a resin having a group derived from each of those substances. Of those, a triarylamine compound and a benzidine compound are preferred because the compounds each have a high suppressive effect on the occurrence of the black spot.

The content of the charge-transporting substance in the charge-transporting layer is preferably 25 mass % or more and 70 mass % or less, more preferably 30 mass % or more and 55 mass % or less with respect to the total mass of the charge-transporting layer.

Examples of the resin include a polyester resin, a polycarbonate resin, an acrylic resin, and a polystyrene resin. Of those, a polycarbonate resin and a polyester resin are preferred. A polyarylate resin is particularly preferred as the polyester resin.

A content ratio (mass ratio) between the charge-transporting substance and the resin is preferably from 4:10 to 20:10, more preferably from 5:10 to 12:10.

In addition, the charge-transporting layer may contain an additive, such as an antioxidant, a UV absorber, a plasticizer, a leveling agent, a slipperiness-imparting agent, or a wear resistance-improving agent. Specific examples thereof include a hindered phenol compound, a hindered amine compound, a sulfur compound, a phosphorus compound, a benzophenone compound, a siloxane-modified resin, a silicone oil, fluorine resin particles, polystyrene resin particles, polyethylene resin particles, silica particles, alumina particles, and boron nitride particles.

The charge-transporting layer has an average thickness of 5 μm or more and 50 μm or less, more preferably 8 μm or more and 40 μm or less, particularly preferably 10 μm or more and 30 μm or less.

The charge-transporting layer may be formed by preparing a coating liquid for a charge-transporting layer containing the above-mentioned materials and a solvent, forming a coat thereof, and drying the coat. Examples of the solvent to be used for the coating liquid include an alcohol-based solvent, a ketone-based solvent, an ether-based solvent, an ester-based solvent, and an aromatic hydrocarbon-based solvent. Of those solvents, an ether-based solvent or an aromatic hydrocarbon-based solvent is preferred.

(2) Monolayer Type Photosensitive Layer

The monolayer type photosensitive layer may be formed by preparing a coating liquid for a photosensitive layer containing the charge-generating substance, the charge-transporting substance, a resin, and a solvent, forming a coat thereof, and drying the coat. Examples of the charge-generating substance, the charge-transporting substance, and the resin are the same as those of the materials in the section "(1) Laminate Type Photosensitive Layer."

<Protective Layer>

A protective layer 1-1 is a layer serving as a surface layer of the photosensitive member and contains a cured product of a composition containing a monomer having a polymerizable functional group. Examples of a reaction for polymerizing a monomer having a polymerizable functional group and curing a composition include a thermal polymerization reaction, a photopolymerization reaction, and a radiation polymerization reaction.

Examples of the monomer having a polymerizable functional group include a compound having a chain-polymerizable functional group such as a (meth)acryloyloxy group or a styryl group, and a compound having a sequentially polymerizable functional group, such as a hydroxyl group, an alkoxysilyl group, or an isocyanate group. The cured product contains at least an aromatic ring and an ester group, and hence it is preferred that the monomer having a polymerizable functional group contained in the composition have a (meth)acryloyloxy group and an aromatic ring. The (meth) acryloyloxy group and the aromatic ring may be contained in one kind of monomer having a polymerizable functional group, or the (meth)acryloyloxy group and the aromatic ring may be contained in different kinds of monomers having polymerizable functional groups, respectively. In addition, the aromatic ring and the ester group in the cured product may not be derived from the monomer having a polymerizable functional group. The aromatic ring and the ester group may not be incorporated into a polymer having a structure derived from the monomer having a polymerizable functional group as long as the aromatic ring and the ester group are present in the protective layer even after the long-term use of the photosensitive member, and the area ratio S1/S2 is not changed.

When the monomer having a polymerizable functional group is a compound having a charge-transporting property, it is preferred to use the above-mentioned charge-transporting substance, a polymerizable monomer having a skeleton of the above-mentioned charge-transporting substance, and/or an oligomer thereof. There are given, for example, a charge-transporting substance having a chain-polymerizable functional group, such as a (meth)acryloyloxy group or a styryl group, a charge-transporting substance having a sequentially polymerizable functional group, such as a hydroxyl group, an alkoxysilyl group, and an isocyanate group, and an oligomer thereof. From the viewpoint of the charge-transporting ability, it is more preferred to use a compound having both a skeleton of a charge-transporting substance and a (meth)acryloyloxy group as the monomer having a polymerizable functional group in the same molecule.

As the compound having a skeleton of a charge-transporting substance and a (meth)acryloyloxy group in the same molecule, for example, compounds represented by the structural formulae OCL-1 to OCL-7, the compounds each having a triarylamine structure as the skeleton of the charge-transporting substance, are preferred.

(OCL-1)

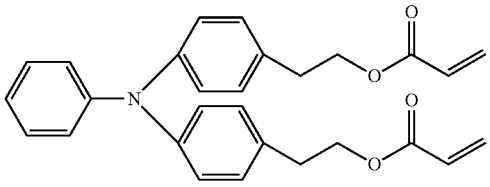

(OCL-2)

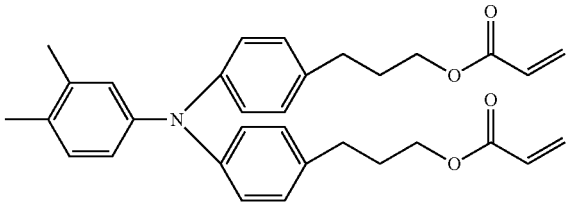

-continued (OCL-3)

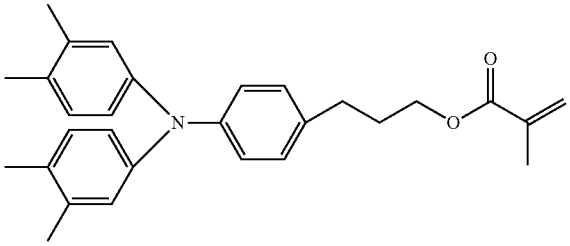

(OCL-4)

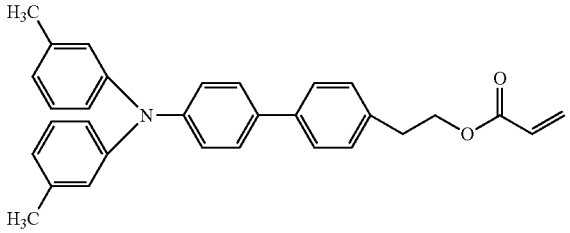

(OCL-5)

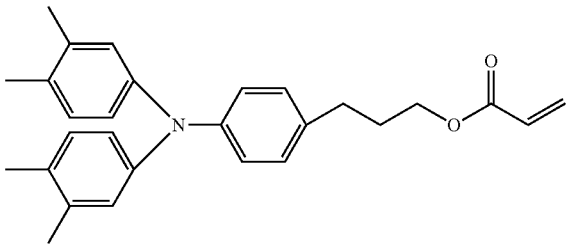

(OCL-6)

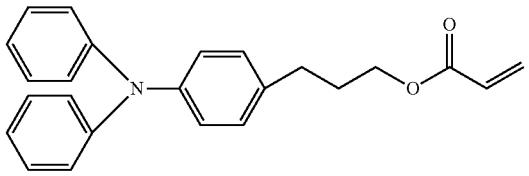

(OCL-7)

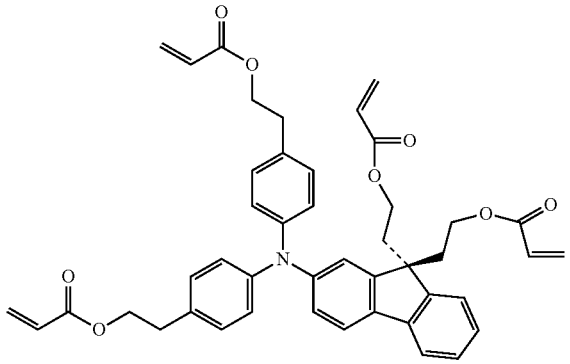

In order to enhance the wear resistance of the protective layer, it is preferred that the protective layer have a structure derived from a monomer having no skeleton of the charge-transporting substance in addition to the structure derived from the polymerizable monomer having a skeleton of the charge-transporting substance.

In addition, it is conceived that, when the protective layer has a structure derived from a monomer having a bulky structure, such as a compound represented by the structural formula (1) or a compound represented by the structural formula (2), the aggregation of ester groups in the protective layer is suppressed, and hence the suppressive effect on the occurrence of banding is further increased.

(1)

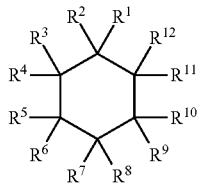

In the structural formula (1), at least two of $R^1$, $R^5$, and $R^9$ represent groups each having a (meth)acryloyloxy group, and $R^1$, $R^5$, and $R^9$ that do not represent the groups each having a (meth)acryloyloxy group each represents a hydrogen atom or a methyl group, and $R^2$ to $R^4$, $R^6$ to $R^8$, and $R^{10}$ to $R^{12}$ each represent a hydrogen atom or a methyl group.

(2)

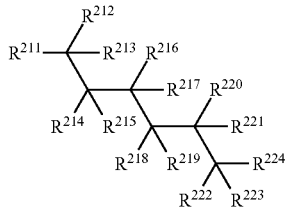

In the structural formula (2), $R^{211}$ and $R^{224}$ each represents group having a (meth)acryloyloxy group, and $R^{212}$ to $R^{223}$ each represents a hydrogen atom or a methyl group.

In the formulae (1) and (2), examples of the group having a (meth)acryloyloxy group comprises a group represented by one structural formula selected from the group consisting of the structural formulae by L-1 to L-5.

L-1

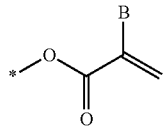

L-2

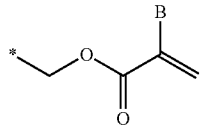

L-3

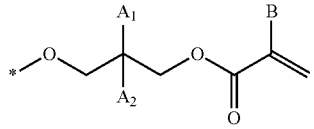

-continued

L-4

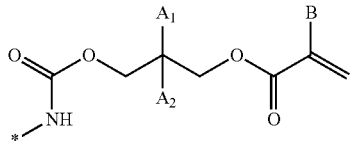

L-5

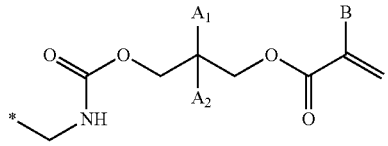

In the structural formulae (L-1) to (L-5), * represents a bonding site with another structure, $A_1$ and $A_2$ each represents a hydrogen atom a group represented by the structural formula (L-1) or a group represented by the structural formula (L-2), and B represents a hydrogen atom or a methyl group.

In the compound represented by the structural formula (1) and the compound represented by the structural formula (2), the group having a (meth)acryloyloxy group may contain a skeleton of the charge-transporting substance. Examples of such group include groups having triarylamine structures to which the groups represented by L-1 to L-5 are bonded.

In the cured product in the protective layer, it is preferred that the mass ratio between the structure derived from the polymerizable monomer having the skeleton of the charge-transporting substance and the structure derived from the polymerizable monomer having no skeleton of the charge-transporting substance (structure derived from the polymerizable monomer having the skeleton of the charge-transporting substance:structure derived from the polymerizable monomer having no skeleton of the charge-transporting substance) be from 7:93 to 50:50. In addition, when the area ratio S1/S2 is 0.10 to 0.27, the molar ratio between the numbers of the aromatic rings and the ester groups (aromatic ring:ester group) on the surface of the protective layer is from 1:1.28 to 1:16.95. Accordingly, it is preferred to design a composition so that the molar ratio between the numbers of the aromatic rings and the ester groups contained in the composition as a coating liquid for a protective layer falls within the above-mentioned range.

Examples of the compound represented by the structural formula (1) include compounds represented by M-1 and M-2. In addition, examples of the compound represented by the structural formula (2) include compounds represented by M-3 and M-4. Further, examples of the monomer having no skeleton of the charge-transporting substance include compounds represented by M-5 to M-7. The compounds represented by M-1 to M-4 are also monomers each having no skeleton of the charge-transporting substance.

M-1
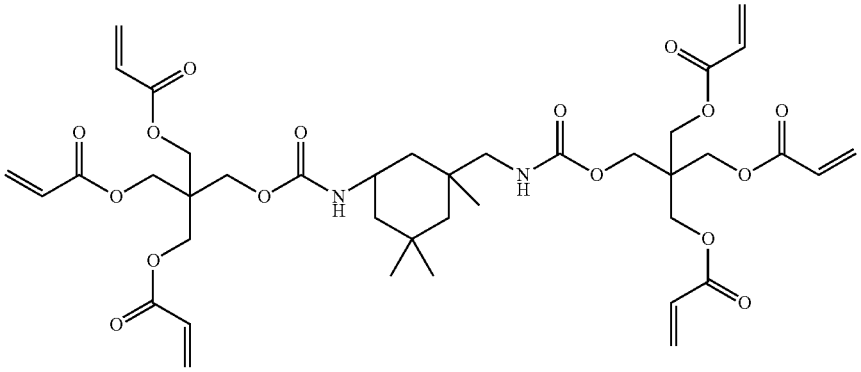
M-2
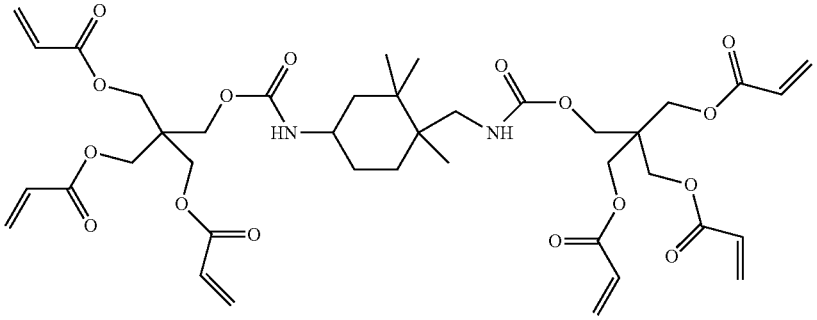
M-3
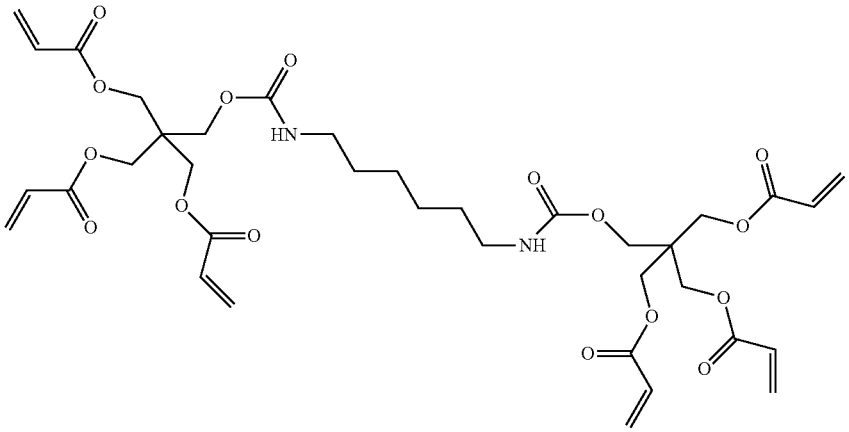
M-4
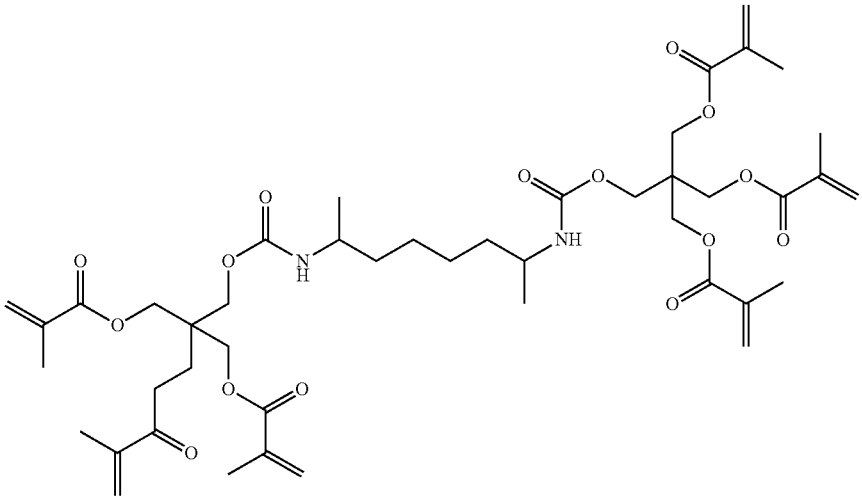

-continued

M-5

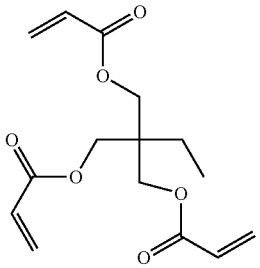

M-6

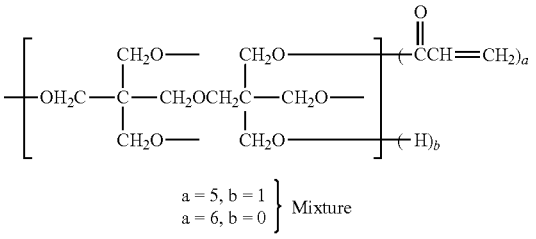

M-7

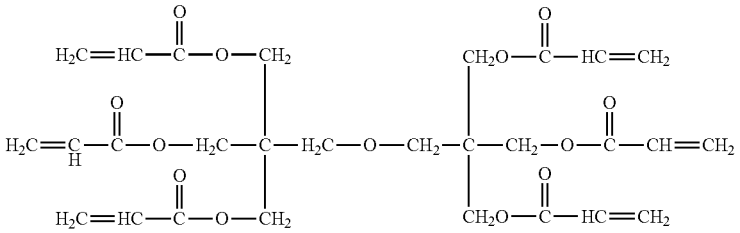

The protective layer may contain an additive, such as an antioxidant, a UV absorber, a plasticizer, a leveling agent, a slipperiness-imparting agent, or a wear resistance-improving agent. Specific examples thereof include a hindered phenol compound, a hindered amine compound, a sulfur compound, a phosphorus compound, a benzophenone compound, a siloxane-modified resin, a silicone oil, fluorine resin particles, polystyrene resin particles, polyethylene resin particles, silica particles, alumina particles, boron nitride particles, titanium oxide, zinc oxide, tin oxide, and indium oxide.

The protective layer has an average thickness of preferably 0.5 μm or more and 10 μm or less, more preferably 1 μm or more and 7 μm or less. In addition, the protective layer may be polished as long as the effect of the present disclosure is not impaired.

The protective layer may be formed as a cured product of a composition by preparing the composition as a coating liquid for a protective layer containing the above-mentioned materials and a solvent, forming a coat thereof, and drying and/or curing the coat. Examples of the solvent to be used for the coating liquid include an alcohol-based solvent, a ketone-based solvent, an ether-based solvent, a sulfoxide-based solvent, an ester-based solvent, and an aromatic hydrocarbon-based solvent.

Further, it is preferred that the protective layer contain a compound having a siloxane structure with hydrophobicity for the purpose of enhancing water repellency or suppressing the adhesion of a discharge product caused by charging. It is conceived that, when the protective layer contains the compound having a siloxane structure, the infiltration of water or the discharge product into the protective layer can be reduced.

In addition, when the protective layer contains the compound having a siloxane structure, the occurrence of banding can be further suppressed.

The photosensitive member is excellent in wear resistance, and hence the compound having a siloxane structure can continue to exist on the surface of the protective layer even after the photosensitive member is used for a long period of time.

Preferred examples of the compound having a siloxane structure include GS-101, US-450, US-270, and US-380 manufactured by Toagosei Co., Ltd., and a siloxane chain is contained in a compound having a site bonded with a (meth)acryloyloxy group.

A preferred proportion of the silicon element on the surface of the protective layer is obtained by X-ray photoelectron spectroscopy. When the total of the concentration of the silicon element, the concentration of the carbon element, the concentration of the oxygen element, and the concentration of the nitrogen element on the surface of the protective layer is set to 100 atomic %, the proportion is 5 to 20 atomic %. When the proportion falls within the above-mentioned range, the occurrence of banding can be further suppressed.

When the proportion of the silicon element is less than 5 atomic %, the ester group is not sufficiently concealed by the compound having a siloxane structure, with the result that the suppressive effect on the occurrence of banding is small. In addition, when the proportion of the silicon element is more than 20 atomic %, the surface of the photosensitive member becomes slippery, and unevenness is liable to occur in the rotation speed ratio D1/D2 of the rotation speed D1 of the developer carrying member to the rotation speed D2 of the electrophotographic photosensitive member, with the result that the suppressive effect on the occurrence of banding is small.

When the amount of the compound having a siloxane structure contained in the composition serving as a coating liquid for a protective layer is set to 1 mass % or more and 20 mass % or less with respect to the total of the mass of the polymerizable monomer having the skeleton of the charge-transporting substance and the mass of the polymerizable monomer having no skeleton of the charge-transporting substance, the proportion of the silicon element on the surface of the protective layer is likely to be 5 to 20 atomic %.

<Toner>

A toner to be used in the present disclosure is not particularly limited. There is given, for example, a toner containing toner particles formed of a styrene-acrylic resin having a weight-average molecular weight of 5,000 or more and 50,000 or less. The toner particles may contain a coloring material, a release agent, and other components contained in known toner particles. The average particle diameter of the toner particles is not limited thereto, but is preferably from 6.0 μm to 10.0 μm.

<Developer>

An external additive may be added to the toner for improving and stabilizing the chargeability of the toner to form a developer.

For example, the following external additive may be used as the external additive.

There are given, for example: fluorine-based resin powders, such as vinylidene fluoride fine powder and polytetrafluoroethylene fine powder; silica fine particles, such as wet process silica and dry process silica, titanium oxide fine particles, and alumina fine particles; hydrophobized fine particles obtained by subjecting the fine particles to surface treatment with a hydrophobizing agent, such as a silane compound, a titanium coupling agent, or a silicone oil; oxides, such as zinc oxide and tin oxide; multiple oxides, such as strontium titanate, barium titanate, calcium titanate, strontium zirconate, and calcium zirconate; and carbonate compounds, such as calcium carbonate and magnesium carbonate. Of those, silica fine particles, titanium oxide fine particles, and strontium titanate are preferred.

Examples of the shape of the external additive include a spherical shape and a rod shape. Of those, a rod shape is preferred from the viewpoint of stability of chargeability.

As a mixing machine for mixing the toner and the external additive, there are given, for example, an FM mixer (manufactured by Nippon Coke and Engineering Co., Ltd.), a super mixer (manufactured by Kawata Mfg. Co., Ltd.), NOBILTA (manufactured by Hosokawa Micron Corporation), and a hybridizer (manufactured by Nara Machinery Co., Ltd.).

[Electrophotographic Apparatus and Process Cartridge]

In addition, an electrophotographic apparatus according to a first embodiment of the present disclosure is characterized by including the electrophotographic photosensitive member described above, a charging unit, an exposing unit, and a developer carrying member as a developing unit.

A process cartridge according to a second embodiment of the present disclosure is characterized by integrally supporting the electrophotographic photosensitive member described above, and at least one unit selected from the group consisting of: a charging unit; a developing unit; and a cleaning unit, and being removably mounted onto the main body of an electrophotographic apparatus.

An example of the schematic configuration of an electrophotographic apparatus including a process cartridge 11 including an electrophotographic photosensitive member is illustrated in FIGURE.

An electrophotographic photosensitive members 1 having a cylindrical shape is rotatable about a shaft 2 and is rotationally driven in a direction indicated by the arrow at a predetermined peripheral speed. The surface of the electrophotographic photosensitive member 1 is charged to a predetermined positive or negative potential by a charging unit 3 for forming a charging portion in contact with the electrophotographic photosensitive member 1. In FIGURE, a roller charging system based on a roller-type charging member is illustrated, but a charging system such as an injection charging system may be adopted. The charged surface of the electrophotographic photosensitive member 1 is irradiated with exposure light 4 from an exposing unit (not shown), and hence an electrostatic latent image corresponding to target image information is formed thereon. The electrostatic latent image formed on the surface of the electrophotographic photosensitive member 1 is developed by supplying a toner (developer) stored in a developing unit 5 by a developer carrying member 13, and a toner image is formed on the surface of the electrophotographic photosensitive member 1. The toner image formed on the surface of the electrophotographic photosensitive member 1 is transferred onto a transfer material 7 by a transferring unit 6. The transfer material 7 onto which the toner image has been transferred is conveyed to a fixing unit 8, is subjected to treatment for fixing the toner image, and is printed out to the outside of the electrophotographic apparatus. The electrophotographic apparatus may include a cleaning unit 9 for removing a deposit, such as the toner remaining on the surface of the electrophotographic photosensitive member 1 after the transfer. The cleaning unit is preferably a cleaning blade containing a urethane resin. In addition, a so-called cleaner-less system for removing the deposit with the developing unit or the like without separate arrangement of the cleaning unit may be used. The electrophotographic apparatus may include an electricity-removing mechanism for subjecting the surface of the electrophotographic photosensitive member 1 to electricity-removing treatment with pre-exposure light 10 from a pre-exposing unit (not shown). In addition, a guiding unit 12 such as a rail may be arranged for removably mounting a process cartridge 11 according to one aspect of the present disclosure onto the main body of an electrophotographic apparatus.

The rotation speed D1 of the developer carrying member 13 is configured so that the rotation number can be changed by changing the current value of a motor for rotating the developer carrying member 13. With this configuration, the rotation speed ratio D1/D2 can be adjusted. A known developer carrying member may be used as the developer carrying member 13.

The electrophotographic apparatus according to one embodiment of the present disclosure may be, for example, a laser beam printer, an LED printer, a copying machine, a facsimile, and a multifunctional peripheral thereof.

EXAMPLES

The present disclosure is described in more detail below by way of Examples and Comparative Examples. The present disclosure is by no means limited to the following Examples, and various modifications may be made without departing from the gist of the present disclosure. In the description in the following Examples, "part(s)" is by mass unless otherwise specified.

<Production of Developer>

[Production of Resin Dispersion Liquid A]

| | |
|---|---|
| Styrene | 312 parts |
| Ethyl acrylate | 64 parts |
| 2-Ethylhexyl acrylate | 24 parts |
| Dodecyl mercaptan | 10 parts |
| Carbon tetrabromide | 3 parts |

The above-mentioned raw materials were mixed in advance and dissolved to prepare a solution (a). Separately, 7 parts of a nonionic surfactant (product name NOVONIL, manufactured by Sanyo Chemical Industries, Ltd.) and 10 parts of an anionic surfactant (product name: NEOGEN R, manufactured by DKS Co., Ltd.) were dissolved in 520 parts of ion-exchanged water to prepare a solution (b). The solution (a) and the solution (b) were placed in a flask, emulsified by dispersion, and slowly mixed for 10 minutes. Further, 70 parts of ion-exchanged water in which 2.5 parts of ammonium persulfate was dissolved was added to the resultant, and nitrogen replacement was performed. Then, the mixed liquid was heated in an oil bath until the content reached 70° C. while the mixed liquid was stirred, and the emulsion polymerization was continued as it was for 6 hours. After that, the reaction solution was cooled to room temperature to obtain a resin dispersion liquid A having a volume-average particle diameter of 152 nm, a glass transition temperature of 55° C., and a peak average molecular weight of 20,000.

[Production of Colorant Dispersion Liquid A]

| | |
|---|---|
| Colorant C.I. Pigment Blue 15:3 | 70 parts |
| Anionic surfactant (product name: NEOGEN, manufactured by DKS Co., Ltd.) | 3 parts |
| Ion-exchanged water | 400 parts |

The above-mentioned raw materials were mixed and dissolved, and then dispersed through use of a homogenizer (Ultra-Turrax, manufactured by IKA) to obtain a colorant dispersion liquid A in which a colorant having a volume-average particle diameter of 150 nm was dispersed.

[Production of Release Agent Dispersion Liquid A]

| | |
|---|---|
| Polyethylene wax (product name: POLYWAX 655, manufactured by Toyo Petrolite Co., Ltd., melting point: 93° C.) | 100 parts |
| Anionic surfactant (product name: Pionin A-45-D, manufactured by Takemoto Oil & Fat Co., Ltd.): | 2 parts |
| Ion-exchanged water | 500 parts |

The above-mentioned raw materials were mixed and dissolved, then dispersed through use of a homogenizer (product name: Ultra-Turrax, manufactured by IKA), and then subjected to dispersion treatment with a pressure ejection homogenizer to obtain a release agent dispersion liquid A in which release agent fine particles made of polyethylene wax having a volume-average particle diameter of 280 nm were dispersed.

Production Example of Developer 1

| | |
|---|---|
| Resin dispersion liquid A | 300 parts |
| Colorant dispersion liquid A | 200 parts |
| Release agent dispersion liquid A | 100 parts |
| BONTRON E-84 (manufactured by Orient Chemical Industries Co., Ltd.) | 5 parts |
| Rosin-modified maleic acid (softening point: 139° C.) | 60 parts (8 mass %) |
| Cationic surfactant (product name: SANISOL B50, manufactured by Kao Corporation) | 3 parts |
| Ion-exchanged water | 500 parts |

The above-mentioned raw materials were mixed and dispersed in a round-bottomed stainless-steel flask through use of a homogenizer (product name: Ultra-Turrax T50, manufactured by IKA) to prepare a mixed liquid. Then, the mixed liquid was heated to 50° C. with stirring in an oil bath for heating and held at 50° C. for 20 minutes to form aggregated particles. Part of the obtained aggregated particles were observed with an optical microscope to find that the volume-average particle diameter of the aggregated particles was about 7.0 μm.

50 Parts of the resin dispersion liquid A was gently added to the liquid in which the aggregated particles were formed, and the resultant was further heated and stirred at 50° C. for 20 minutes to obtain an aggregated particle dispersion liquid A. The obtained aggregated particle dispersion liquid A was observed with an optical microscope to find that the volume-average particle diameter of the aggregated particles was about 7.3 μm.

Next, 6 parts of sodium dodecylbenzenesulfonate (product name: NEOGEN SC, manufactured by DKS Co., Ltd.) was added as an anionic surfactant to the aggregated particle dispersion liquid A, and the mixture was heated to 97° C. and held as it was for 7 hours, to thereby fuse the aggregated particles to each other. After that, the resultant was cooled to 45° C. at a temperature decrease rate of 1.0° C./min, filtered, then thoroughly washed with ion-exchanged water, and further filtered through a 400-mesh sieve. The volume-average particle diameter of the fused aggregated particles was measured to be 7.4 μm with a Coulter counter. The resultant was dried with a vacuum dryer to obtain toner particles 1.

3.2 Parts of hydrophobic silica fine powder having a primary particle diameter of 6 nm treated with 18 parts of silicone oil based on 100 parts of silica powder, 0.9 part of hydrophobic titanium oxide, serving as titanium oxide fine powder, obtained by treating needle-shaped titanium oxide (FTL-100, manufactured by Ishihara Sangyo Co., Ltd.) with 10 parts of isobutyltrimethoxysilane in toluene, and then filtering, drying, and classifying the resultant, and 0.1 part of PMMA spherical resin fine particles each having a primary particle diameter of 330 nm were added to 100 parts of the obtained toner particles 1, and the resultant was mixed through use of a Henschel mixer to obtain a developer 1.

Production Example of Developer 2

A developer 2 was obtained by the same method as in the production example of the developer 1 except that the amount of the needle-shaped titanium oxide was changed to 1.1 parts.

Production Example of Developer 3

Production of Styrene-Acrylic Resin A

| | |
|---|---|
| Styrene | 79.0 parts |
| Toluene | 100.0 parts |
| n-Butyl acrylate | 20.0 parts |
| Acrylic acid | 1.0 part |
| Di-t-butyl peroxide (PBD) | 7.2 parts |

The above-mentioned raw materials were placed in a reaction vessel with a reflux condenser, a stirrer, and a nitrogen inlet tube under a nitrogen atmosphere. The raw material mixture in the vessel was heated to 110° C. and stirred at 200 rpm for 10 hours. Further, the heating temperature was raised to 140° C., and the polymerization reaction was performed for 6 hours. A solvent (toluene) was distilled off to obtain a styrene-acrylic resin A having a weight-average molecular weight (Mw) of 26,000 and a glass transition point of 73° C.

| | |
|---|---|
| Styrene-acrylic resin A | 100.0 parts |
| Carbon black (manufactured by Orion Engineered Carbons, product name "Printex 35") | 7.0 parts |

-continued

| | |
|---|---|
| Synthetic wax (manufactured by Schumann-Sasol Ltd., Sasolwax SPRAY 30, melting point: 98° C.) | 3.0 parts |
| Carbon black | 7.0 parts |
| Magnetic material | 4.0 parts |

The above-mentioned raw materials were mixed well with a Henschel mixer (product name: Model FM-75, manufactured by Mitsui Miike Chemical Engineering Machinery, Co., Ltd.), and then kneaded in a twin-screw kneader (product name: Model PCM-30, manufactured by Ikegai Ironworks Corp.) set to a temperature of 125° C. The resultant kneaded product was gradually cooled to room temperature. After that, the resultant was coarsely pulverized with a cutter mill, pulverized through use of a fine pulverizer using a jet stream, and air-classified to produce toner particles 3 having a volume-average particle diameter of 8.5 μm.

0.6 Part of needle-shaped titanium oxide (product name: FTL-100, manufactured by Ishihara Sangyo Co., Ltd.) surface-treated with 15.0 mass % of isobutyltrimethoxysilane and 1.8 parts of hydrophobic silica fine particles having a number-average particle diameter of primary particles of 16 nm surface-treated with 20.0 mass % of hexamethyldisilazane were added to 98.2 parts of the obtained toner particles 3, and the resultant was mixed with a Henschel mixer (product name: Model FM-75, manufactured by Mitsui Miike Chemical Engineering Machinery, Co., Ltd.) to obtain a developer 3.

Production Example of Developer 4

A developer 4 was obtained in the same manner as in the production example of the developer 3 except that the addition amount of the needle-shaped titanium oxide was changed to 0.9 part in the production example of the developer 3.

Production Example of Developer 5

A developer 5 was obtained in the same manner as in the production example of the developer 1 except that the needle-shaped titanium oxide was changed to titanium oxide fine particles (KR-310, manufactured by Titan Kogyo, Ltd.) surface-treated with 15.0 mass % of isobutyltrimethoxysilane in the production example of the developer 1.

Production Example of Developer 6

A developer 6 was obtained in the same manner as in the production example of the developer 3 except that the needle-shaped titanium oxide surface-treated with 15.0 mass % of isobutyltrimethoxysilane was changed to titanium oxide fine particles (KR-310, manufactured by Titan Kogyo, Ltd.) surface-treated with 15.0 mass % of isobutyltrimethoxysilane in the production example of the developer 3.

<Production of Support of Electrophotographic Photosensitive Member and Coating Liquid for Each Layer>

Preparation of Support

A cylinder formed of an aluminum alloy (JIS-A3003, aluminum alloy) having an outer diameter of 24 mm, a length of 257 mm, and a thickness of 0.9 mm, whose surface had been roughly cut, was mounted onto an NC lathe, and subjected to tool bit cutting processing with a diamond sintered tool bit so as to have an outer diameter of 23.97 mm and a surface roughness Ra(S80) of 0.02 μm, while the abutting angle of the diamond sintered tool bit with respect to an element tube was changed between 0° and 3°, to thereby produce a support. The tool bit cutting processing was performed under the following conditions: the number of main axis revolutions of the lathe was set to 3,000 rpm, and the moving speed of the tool bit (tool bit feed rate) was changed with a program for repeatedly increasing and decreasing the feed rate so as to change the feed rate by 0.005 mm/revolution every 1.5 mm of processing distance between 0.340 mm/revolution and 0.360 mm/revolution.

ΔL on the outer peripheral surface of the support was measured to be 50 μm.

ΔL was measured as described above using a profile curve of the outer peripheral surface of the support near its center obtained by roughness measurement performed with "Surfcom 1400D" (manufactured by Tokyo Seimitsu Co., Ltd.) in accordance with the JIS1994 standard under the measurement conditions of a measurement length of 4.0 mm, a long wavelength cutoff λc of 0.8 mm (Gaussian), and a measurement speed of 0.3 mm/sec.

In addition, Ra(S80) is an arithmetic average roughness Ra obtained near the center of the outer peripheral surface of the support by roughness measurement performed with "Surfcom 1400D" (manufactured by Tokyo Seimitsu Co., Ltd.) in accordance with the JIS'01 standard under the measurement conditions of a measurement length of 4.0 mm, a long wavelength cutoff λc of 0.8 mm (Gaussian), a short wavelength cutoff λs of 80 μm, and a measurement speed of 0.3 mm/sec.

Preparation of Coating Liquid for Undercoat Layer

A coating liquid for forming an undercoat layer was prepared as described below. Rutile-type titanium oxide having an average primary particle diameter of 40 nm (product name TTO55N, manufactured by Ishihara Sangyo Kaisha, Ltd.), and 3 mass % of methyldimethoxysilane (product name: TSL8117, manufactured by Toshiba Silicone Co., Ltd.) with respect to the titanium oxide were mixed in a Henschel mixer to provide surface-treated titanium oxide. After that, the surface-treated titanium oxide was dispersed in a mixed solvent having a mass ratio of methanol/1-propanol of 7/3 with a ball mill to prepare a dispersed slurry of the surface-treated titanium oxide.

The obtained dispersed slurry, and a mixed solvent of methanol/1-propanol/toluene and pellets of copolymerized polyamide formed of ε-caprolactam represented by the formula (D)/bis(4-amino-3-methylcyclohexyl)methane represented by the formula (E)/hexamethylenediamine represented by the formula (F)/decamethylenedicarboxylic acid represented by the formula (G)/octadecamethylenedicarboxylic acid represented by the formula (H) at a compositional molar ratio of 60%/15%/5%/15%/5% were stirred and mixed while being heated to dissolve the polyamide pellets. After that, ultrasonic dispersion treatment was performed to prepare a coating liquid for forming an undercoat layer containing surface-treated titanium oxide/copolymerized polyamide at a mass ratio of 3/1, and having a solid content concentration of 18.0% in a mixed solvent formed of methanol/1-propanol/toluene at a mass ratio of 7/1/2.

(D)

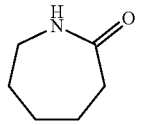

-continued (E)

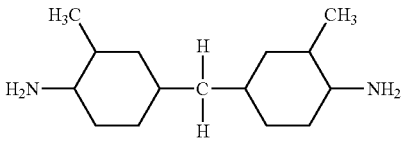

(F)

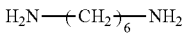

(G)

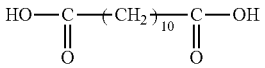

(H)

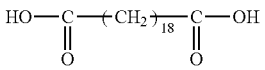

Filter: not used
Incident monochromator: used
Counter monochromator: not used
Divergence slit: open
Divergence vertical limit slit: 10.00 mm
Scattering slit: open
Receiving slit: open
Plate monochromator: used
Counter: scintillation counter Preparation of Coating Liquid for Charge-Transporting Layer 10 Parts of a charge-transporting substance (hole-transportable substance) represented by the structural formula (CTM-1), and 10 parts of a polycarbonate resin having copolymerization units represented by the structural formula (PC-1) and the structural formula (PC-2) (PC-1/PC-2=90/10, Mv=40,000) were dissolved in a mixed solvent of 55 parts of toluene and 45 parts of tetrahydrofuran to prepare a coating liquid for a charge-transporting layer.

(CTM-1)

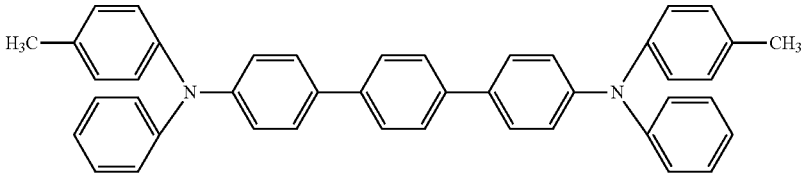

(PC-1)

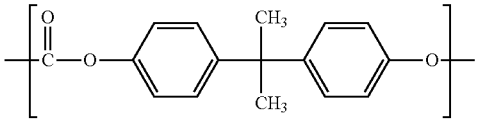

(PC-2)

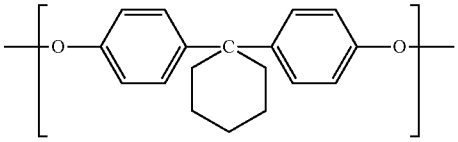

Preparation of Coating Liquid for Charge-Generating Layer

10 Parts of a Y-type oxytitanium phthalocyanine crystal having a strong peak at a Bragg angle (2θ±0.2°) in CuKα characteristic X-ray diffraction of 27.3° serving as a charge-generating substance, and 150 parts of 4-methoxy-4-methyl-2-pentanone were placed in a sand mill using glass beads each having a diameter of 1 mm, and subjected to pulverization and dispersion treatment with a sand grind mill for 1.5 hours. Next, 105 parts of a solution obtained by dissolving 5 parts of a polyacetal resin (product name: S-LEC BX-1, manufactured by Sekisui Chemical Co., Ltd.) in 100 parts of 4-methoxy-4-methyl-2-pentanone was added to the sand mill, and the resultant mixture was subjected to dispersion treatment for 0.5 hour. After that, 250 parts of 1,2-dimethoxyethane was further added to the sand mill to prepare a coating liquid for a charge-generating layer.

Measurement of X-ray diffraction was performed under the following conditions.

[Powder X-Ray Diffraction Measurement]
Used measurement device: X-ray diffractometer RINT-TTR II, manufactured by Rigaku Corporation
X-ray tube: Cu
Tube voltage: 50 KV
Tube current: 300 mA
Scanning method: 2θ/θ scan
Scanning speed: 4.0°/min
Sampling interval: 0.02°
Start angle (2θ): 5.0°
Stop angle (2θ): 40.0°
Attachment: standard sample holder Preparation of Coating Liquid 1 for Protective Layer

| | |
|---|---|
| Compound represented by the structural formula (OCL-4) | 6.09 parts |
| Compound represented by the structural formula (M-5) | 6.41 parts |
| 1-Hydroxycyclohexyl phenyl ketone represented by the structural formula (I) | 1.00 part |

The above-mentioned raw materials were mixed with a mixed solvent of 72 parts of 2-propanol and 8 parts of tetrahydrofuran and stirred to prepare a coating liquid 1 for a protective layer.

(I)

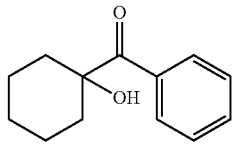

Preparation of Coating Liquid 2 for Protective Layer

A coating liquid 2 for a protective layer was prepared in the same manner as in the preparation of the coating liquid 1 for a protective layer except that the amount of the compound represented by the structural formula (OCL-4) was changed to 3.55 parts and the amount of the compound represented by the structural formula (M-5) was changed to 8.95 parts.

Preparation of Coating Liquid 3 for Protective Layer

A coating liquid 3 for a protective layer was prepared in the same manner as the coating liquid 1 for a protective layer except that the amount of the compound represented by the structural formula (OCL-4) was changed to 5.00 parts and the compound represented by the structural formula (M-5) was changed to 7.50 parts of the compound represented by the structural formula (M-6).

Preparation of Coating Liquid 4 for Protective Layer

A coating liquid 4 for a protective layer was prepared in the same manner as the coating liquid 1 for a protective layer except that the amount of the compound represented by the structural formula (OCL-4) was changed to 3.59 parts and the compound represented by the structural formula (M-5) was changed to 8.91 parts of the compound represented by the structural formula (M-6).

Preparation of Coating Liquid 5 for Protective Layer

A coating liquid 5 for a protective layer was prepared in the same manner as the coating liquid 1 for a protective layer except that the amount of the compound represented by the structural formula (OCL-4) was changed to 0.96 part and the compound represented by the structural formula (M-5) was changed to 11.54 parts of the compound represented by the structural formula (M-6).

Preparation of Coating Liquid 6 for Protective Layer

A coating liquid 6 for a protective layer was prepared in the same manner as the coating liquid 1 for a protective layer except that the compound represented by the structural formula (OCL-4) was changed to 6.25 parts of the compound represented by the structural formula (OCL-1) and the compound represented by the structural formula (M-5) was changed to 6.25 parts of the compound represented by the structural formula (M-1).

Preparation of Coating Liquid 7 for Protective Layer

A coating liquid 7 for a protective layer was prepared in the same manner as the coating liquid 1 for a protective layer except that the compound represented by the structural formula (OCL-4) was changed to 3.50 parts of the compound represented by the structural formula (OCL-1) and the compound represented by the structural formula (M-5) was changed to 9.00 parts of the compound represented by the structural formula (M-1).

Preparation of Coating Liquid 8 for Protective Layer

A coating liquid 8 for a protective layer was prepared in the same manner as the coating liquid 1 for a protective layer except that the compound represented by the structural formula (OCL-4) was changed to 3.50 parts of the compound represented by the structural formula (OCL-1) and the compound represented by the structural formula (M-5) was changed to 9.00 parts of the compound represented by the structural formula (M-3).

Preparation of Coating Liquid 9 for Protective Layer

A coating liquid 9 for a protective layer was prepared in the same manner as the coating liquid 1 for a protective layer except that the compound represented by the structural formula (OCL-4) was changed to 2.19 parts of the compound represented by the structural formula (OCL-1) and the compound represented by the structural formula (M-5) was changed to 10.30 parts of the compound represented by the structural formula (M-1).

Preparation of Coating Liquid 10 for Protective Layer

A coating liquid 10 for a protective layer was prepared in the same manner as the coating liquid 1 for a protective layer except that the compound represented by the structural formula (OCL-4) was changed to 2.25 parts of the compound represented by the structural formula (OCL-1) and the compound represented by the structural formula (M-5) was changed to 10.25 parts of the compound represented by the structural formula (M-1).

Preparation of Coating Liquid 11 for Protective Layer

A coating liquid 11 for a protective layer was prepared in the same manner as the coating liquid 1 for a protective layer except that the compound represented by the structural formula (OCL-4) was changed to 3.13 parts of the compound represented by the structural formula (OCL-1) and the compound represented by the structural formula (M-5) was changed to 9.38 parts of the compound represented by the structural formula (M-1).

Preparation of Coating Liquid 12 for Protective Layer

A coating liquid 12 for a protective layer was prepared in the same manner as the coating liquid 1 for a protective layer except that the compound represented by the structural formula (OCL-4) was changed to 3.31 parts of the compound represented by the structural formula (OCL-1) and the compound represented by the structural formula (M-5) was changed to 9.19 parts of the compound represented by the structural formula (M-1).

Preparation of Coating Liquid 13 for Protective Layer

A coating liquid 13 for a protective layer was prepared in the same manner as the coating liquid 1 for a protective layer except that the compound represented by the structural formula (OCL-4) was changed to 3.33 parts of the compound represented by the structural formula (OCL-1) and the compound represented by the structural formula (M-5) was changed to 9.18 parts of the compound represented by the structural formula (M-3).

Preparation of Coating Liquid 14 for Protective Layer

A coating liquid 14 for a protective layer was prepared in the same manner as the coating liquid 1 for a protective layer except that the compound represented by the structural formula (OCL-4) was changed to 3.13 parts of the compound represented by the structural formula (OCL-1) and the compound represented by the structural formula (M-5) was changed to 9.38 parts of the compound represented by the structural formula (M-1).

Preparation of Coating Liquid 15 for Protective Layer 0.13 Part of a siloxane-modified acrylic compound (product name: US-270, manufactured by Toagosei Co., Ltd.) was added to the coating liquid 14 for a protective layer, followed by stirring, to prepare a coating liquid 15 for a protective layer.

Preparation of Coating Liquid 16 for Protective Layer 0.13 Part of a siloxane-modified acrylic compound (product name: US-270, manufactured by Toagosei Co., Ltd.) was added to the coating liquid 11 for a protective layer, followed by stirring, to prepare a coating liquid 16 for a protective layer.

Preparation of Coating Liquid 17 for Protective Layer 0.83 Part of a siloxane-modified acrylic compound (product name: US-270, manufactured by Toagosei Co., Ltd.) was added to the coating liquid 11 for a protective layer, followed by stirring, to prepare a coating liquid 17 for a protective layer.

Preparation of Coating Liquid 18 for Protective Layer 0.08 Part of a siloxane-modified acrylic compound (product name: US-270, manufactured by Toagosei Co., Ltd.) was added to the coating liquid 11 for a protective layer, followed by stirring, to prepare a coating liquid 18 for a protective layer.

Preparation of Coating Liquid 19 for Protective Layer 1.12 Parts of a siloxane-modified acrylic compound (product name: US-270, manufactured by Toagosei Co., Ltd.) was added to the coating liquid 11 for a protective layer, followed by stirring, to prepare a coating liquid 19 for a protective layer.

Preparation of Comparative Coating Liquid 1 for Protective Layer

A comparative coating liquid 1 for a protective layer was prepared in the same manner as the coating liquid 1 for a protective layer except that the compound represented by the structural formula (OCL-4) was changed to 0.56 part of the compound represented by the structural formula (OCL-1) and the compound represented by the structural formula (M-5) was changed to 11.94 parts of the compound represented by the structural formula (M-1).

Preparation of Comparative Coating Liquid 2 for Protective Layer

A comparative coating liquid 2 for a protective layer was prepared in the same manner as the coating liquid 1 for a protective layer except that the amount of the compound represented by the structural formula (OCL-4) was changed to 6.25 parts and the compound represented by the structural formula (M-5) was changed to 6.25 parts of the compound represented by the structural formula (M-6).

<Production of Electrophotographic Photosensitive Member>

Production of Photosensitive Member 1

The coating liquid for an undercoat layer prepared in the foregoing was applied onto a support by dip coating, and dried at 100° C. for 10 minutes, to thereby form an undercoat layer having a thickness of 2.0 μm.

The coating liquid for a charge-generating layer prepared in the foregoing was applied onto the obtained undercoat layer by dip coating, and dried at 100° C. for 10 minutes, to thereby form a charge-generating layer having a thickness of 0.15 μm.

The coating liquid for a charge-transporting layer prepared in the foregoing was applied onto the obtained charge-generating layer by dip coating, and dried at 120° C. for 30 minutes, to thereby form a charge-transporting layer having a thickness of 16.0 μm.

The coating liquid 1 for a protective layer was applied onto the obtained charge-transporting layer by dip coating to form a coat, and the resultant coat was dried at 50° C. for 6 minutes. After that, through use of an electrodeless lamp H bulb (manufactured by Heraeus), the coat was irradiated with UV light for 10 seconds under the condition of a lamp intensity of 0.6 W/cm$^2$ while the support (object to be irradiated) was rotated at a speed of 300 Rpm. Next, the coat was naturally cooled until its temperature became 25° C., and then the coat was subjected to heating treatment for 1 hour under such a condition that its temperature became 125° C., to thereby form a protective layer having a thickness of 3 μm. Thus, a photosensitive member 1 was produced.

The presence or absence of the structure derived from the compound represented by the structural formula (1) and the structure derived from the compound represented by the structural formula (2) in the protective layer was identified under the following conditions through use of the produced photosensitive member 1.

The protective layer of the photosensitive member 1 was peeled off by scraping with a razor, and the mass of the protective layer was measured. The peeled protective layer was immersed in chloroform and irradiated with an ultrasonic wave for 1 hour by an ultrasonic apparatus. After that, a component insoluble in chloroform was taken out and dried to obtain a residue, and the residue was measured by pyrolysis-GCMS in accordance with the following procedure. A TMAH methylating agent and the residue were mixed, and the mixture was thermally decomposed with a thermal decomposition apparatus (product name: JPS-700, manufactured by Japan Analytical Industry Co., Ltd.) to obtain a sample. Then, the sample was introduced into GCMS (product name: ISQ (FOCUS GC), manufactured by Thermo Fisher Scientific) and analyzed. In addition, thermal decomposition and GCMS analysis were performed in the same manner also on only the residue without being mixed with the TMAH methylating agent.

In the above-mentioned measurement, a triphenylamine structure and a (meth)acryloyloxy group were detected. In addition, in the analysis without using the TMAH methylating agent, it was identified whether or not the structure derived from the compound represented by the structural formula (1) or the structure derived from the compound represented by the structural formula (2) was contained. It was identified that the protective layer of the photosensitive member 1 did not contain the structure derived from the compound represented by the structural formula (1) and the structure derived from the compound represented by the structural formula (2).

<Measurement of Area Ratio S1/S2>

The surface at a center position in a longitudinal direction of the produced photosensitive member 1 was measured by attenuated total reflection Fourier transform infrared spectroscopy for infrared spectroscopic spectra at from 600 cm$^{-1}$ to 4,000 cm$^{-1}$ under the following conditions, and the area ratio S1/S2 was determined.

(Measurement Conditions)

Apparatus: FT/IR-420 (manufactured by JASCO Corporation)

Auxiliary apparatus: ATR apparatus

Internal reflection element (IRE): Ge

Incident angle: 45 degrees

Number of scans: 32

For the obtained spectra, S1 and S2 were determined by the following methods.

(1) The difference between each measurement point at from 1,530 cm$^{-1}$ to 1,470 cm$^{-1}$ and a baseline connecting 1,530 cm$^{-1}$ and 1,470 cm$^{-1}$ with a straight line was calculated as a peak area S1.

(Measurement accuracy: 1 cm$^{-1}$)

(2) The difference between each measurement point at from 1,770 cm$^{-1}$ to 1,700 cm$^{-1}$ and a baseline connecting 1,770 cm$^{-1}$ and 1,700 cm$^{-1}$ with a straight line was calculated as a peak area S2.

(Measurement accuracy: 1 cm$^{-1}$)

<Measurement of Proportion of Silicon Element on Surface of Photosensitive Member>

The abundance (atomic %) of the silicon element on the surface of the photosensitive member was measured by X-ray photoelectron spectroscopy (ESCA). The photosensitive member 1 was fixed, and a portion measuring 10 mm per side was cut out from a center position in a longitudinal direction of the photosensitive member through use of a saw to be used as a measurement sample. The measurement conditions are described below.

Apparatus name: VersaProbeII

Excitation X-ray: AlKα, photoelectron takeoff angle: 45°

X-ray: 100 μm 25 W 15 kV 100 μm spot analysis

Electron neutralization gun: 20 μA, 1 V ion neutralization gun: 7 mA, 10 V

Pass energy: 58.70 eV, Step size: 0.125 eV

Sweep number: C: 10 times, O: 10 times, Si: 30 times, N: 30 times

Production of Photosensitive Members 2 to 19 and Comparative Photosensitive Members 1 and 2

Photosensitive members 2 to 19 and comparative photosensitive members 1 and 2 were produced in the same manner as the photosensitive member 1 except that the coating liquid for a protective layer was changed as shown in Table 1 in the photosensitive member 1 to produce the photosensitive members.

TABLE 1

| | Coating liquid for protective layer | Structural formula (1) or structural formula (2) | Si Atom % |
|---|---|---|---|
| Photosensitive member 1 | Coating liquid 1 for protective layer | Absent | 0 |
| Photosensitive member 2 | Coating liquid 2 for protective layer | Absent | 0 |
| Photosensitive member 3 | Coating liquid 3 for protective layer | Absent | 0 |
| Photosensitive member 4 | Coating liquid 4 for protective layer | Absent | 0 |
| Photosensitive member 5 | Coating liquid 5 for protective layer | Absent | 0 |
| Photosensitive member 6 | Coating liquid 6 for protective layer | Present | 0 |
| Photosensitive member 7 | Coating liquid 7 for protective layer | Present | 0 |
| Photosensitive member 8 | Coating liquid 8 for protective layer | Present | 0 |
| Photosensitive member 9 | Coating liquid 9 for protective layer | Present | 0 |
| Photosensitive member 10 | Coating liquid 10 for protective layer | Present | 0 |
| Photosensitive member 11 | Coating liquid 11 for protective layer | Present | 0 |
| Photosensitive member 12 | Coating liquid 12 for protective layer | Present | 0 |
| Photosensitive member 13 | Coating liquid 13 for protective layer | Present | 0 |
| Photosensitive member 14 | Coating liquid 14 for protective layer | Present | 0 |
| Photosensitive member 15 | Coating liquid 15 for protective layer | Present | 5 |
| Photosensitive member 16 | Coating liquid 16 for protective layer | Present | 5 |
| Photosensitive member 17 | Coating liquid 17 for protective layer | Present | 20 |
| Photosensitive member 18 | Coating liquid 18 for protective layer | Present | 4 |
| Photosensitive member 19 | Coating liquid 19 for protective layer | Present | 21 |
| Comparative photosensitive member 1 | Comparative coating liquid 1 for protective layer | Present | 5 |
| Comparative photosensitive member 2 | Comparative coating liquid 2 for protective layer | Absent | 5 |

<Mounting on Image Forming Apparatus>

Examples 1 to 35 and Comparative Examples 1 to 5

Each of the photosensitive members shown in Table 2 was mounted on an electrophotographic image forming apparatus.

A reconstructed machine of a laser beam printer (product name: HP Color LaserJet Enterprise M653dn, manufactured by Hewlett-Packard Company) was used as an electrophotographic image forming apparatus. The electrophotographic image forming apparatus was reconstructed so as to be capable of adjusting the rotation speed and process speed of a developer carrying member and a photosensitive member. The amount of a toner to be carried on the developer carrying member was adjusted to be constant, and in addition, the charging potential and the image exposure light amount at the time of solid black output were adjusted. Thus, evaluation was performed at a constant charging potential (−600 V) and a constant exposure potential (−150 V).

First, the electrophotographic image forming apparatus and the photosensitive member were left to stand for 24 hours or more under an environment having a temperature of 23° C. and a humidity of 50% RH. Then, the photosensitive member was mounted on a process cartridge of a cyan color of the electrophotographic image forming apparatus.

A halftone image (image in which a line with a width of 1 dot is drawn at an interval of 2 dots in a direction perpendicular to a rotation direction of the electrophotographic photosensitive member) was output continuously on 100 sheets of $A_4$-size plain paper.

The evaluation was performed by visually observing the 100 sheets based on ranks shown in Table 3. The results are shown in Table 2.

D1/D2 was calculated through use of the length of one circumference of a drum of 75.36 mm and the length of one circumference of the developer carrying member of 37.68 mm.

$$D1/D2=(D1\times 37.68)/(D2\times 75.36)$$

TABLE 2

| | Photosensitive member | S1/S2 | Rotation number of developer carrying member (rpm) | Rotation number of photosensitive member (rpm) | D1/D2 % | Process speed sheets per min | Developer | Rank |
|---|---|---|---|---|---|---|---|---|
| Example 1 | Photosensitive member 1 | 0.270 | 520 | 216 | 1.20 | 55 | Developer 1 | G |
| Example 2 | Photosensitive member 1 | 0.270 | 413 | 216 | 0.96 | 55 | Developer 1 | G |
| Example 3 | Photosensitive member 2 | 0.175 | 474 | 216 | 1.10 | 55 | Developer 1 | G |
| Example 4 | Photosensitive member 3 | 0.225 | 474 | 216 | 1.10 | 55 | Developer 1 | H |
| Example 5 | Photosensitive member 4 | 0.175 | 474 | 216 | 1.10 | 55 | Developer 1 | H |
| Example 6 | Photosensitive member 5 | 0.100 | 520 | 216 | 1.20 | 55 | Developer 1 | I |
| Example 7 | Photosensitive member 5 | 0.100 | 413 | 216 | 0.96 | 55 | Developer 1 | I |
| Example 8 | Photosensitive member 6 | 0.258 | 520 | 216 | 1.20 | 55 | Developer 1 | F |
| Example 9 | Photosensitive member 7 | 0.175 | 474 | 216 | 1.10 | 55 | Developer 1 | E |
| Example 10 | Photosensitive member 8 | 0.175 | 474 | 216 | 1.10 | 55 | Developer 1 | E |
| Example 11 | Photosensitive member 9 | 0.138 | 474 | 216 | 1.10 | 55 | Developer 1 | E |
| Example 12 | Photosensitive member 10 | 0.140 | 474 | 216 | 1.10 | 55 | Developer 1 | D |
| Example 13 | Photosensitive member 11 | 0.166 | 453 | 216 | 1.05 | 55 | Developer 1 | D |

TABLE 2-continued

| | Photosensitive member | S1/S2 | Rotation number of developer carrying member (rpm) | Rotation number of photosensitive member (rpm) | D1/D2 % | Process speed sheets per min | Developer | Rank |
|---|---|---|---|---|---|---|---|---|
| Example 14 | Photosensitive member 11 | 0.166 | 453 | 216 | 1.05 | 55 | Developer 1 | D |
| Example 15 | Photosensitive member 12 | 0.170 | 413 | 216 | 0.96 | 55 | Developer 1 | D |
| Example 16 | Photosensitive member 13 | 0.170 | 413 | 216 | 0.96 | 55 | Developer 1 | D |
| Example 17 | Photosensitive member 11 | 0.166 | 409 | 216 | 0.95 | 55 | Developer 1 | C |
| Example 18 | Photosensitive member 11 | 0.166 | 388 | 216 | 0.90 | 55 | Developer 1 | C |
| Example 19 | Photosensitive member 11 | 0.166 | 388 | 216 | 0.80 | 55 | Developer 1 | C |
| Example 20 | Photosensitive member 11 | 0.166 | 409 | 216 | 0.95 | 55 | Developer 1 | C |
| Example 21 | Photosensitive member 11 | 0.166 | 347 | 216 | 0.80 | 55 | Developer 1 | C |
| Example 22 | Photosensitive member 14 | 0.150 | 409 | 216 | 0.95 | 55 | Developer 1 | C |
| Example 23 | Photosensitive member 14 | 0.150 | 347 | 216 | 0.80 | 55 | Developer 1 | C |
| Example 24 | Photosensitive member 11 | 0.166 | 427 | 236 | 0.90 | 60 | Developer 1 | C |
| Example 25 | Photosensitive member 14 | 0.150 | 427 | 236 | 0.90 | 60 | Developer 1 | C |
| Example 26 | Photosensitive member 14 | 0.150 | 458 | 254 | 0.90 | 65 | Developer 1 | C |
| Example 27 | Photosensitive member 15 | 0.150 | 458 | 254 | 0.90 | 65 | Developer 1 | A |
| Example 28 | Photosensitive member 16 | 0.166 | 458 | 254 | 0.90 | 65 | Developer 1 | A |
| Example 29 | Photosensitive member 17 | 0.166 | 458 | 254 | 0.90 | 65 | Developer 1 | A |
| Example 30 | Photosensitive member 16 | 0.166 | 458 | 254 | 0.90 | 65 | Developer 2 | A |
| Example 31 | Photosensitive member 18 | 0.166 | 458 | 254 | 0.90 | 65 | Developer 2 | B |
| Example 32 | Photosensitive member 16 | 0.166 | 458 | 254 | 0.90 | 65 | Developer 3 | A |
| Example 33 | Photosensitive member 16 | 0.166 | 458 | 254 | 0.90 | 65 | Developer 4 | A |
| Example 34 | Photosensitive member 16 | 0.166 | 458 | 254 | 0.90 | 65 | Developer 5 | B |
| Example 35 | Photosensitive member 19 | 0.166 | 458 | 254 | 0.90 | 65 | Developer 6 | C |
| Comparative Example 1 | Comparative photosensitive member 1 | 0.090 | 388 | 216 | 0.90 | 55 | Developer 1 | K |
| Comparative Example 2 | Comparative photosensitive member 1 | 0.090 | 458 | 254 | 0.90 | 65 | Developer 1 | M |
| Comparative Example 3 | Comparative photosensitive member 2 | 0.275 | 458 | 254 | 0.90 | 65 | Developer 1 | L |
| Comparative Example 4 | Photosensitive member 12 | 0.170 | 636 | 254 | 1.25 | 65 | Developer 1 | J |
| Comparative Example 5 | Photosensitive member 12 | 0.170 | 382 | 254 | 0.75 | 65 | Developer 1 | J |

TABLE 3

| Rank | Evaluation criteria |
|---|---|
| A | No horizontal streak is recognized in the halftone images. |
| B | A significantly slight horizontal streak is recognized at a pitch of the developer carrying member in the first halftone image, but no horizontal streak is recognized in the second and subsequent halftone images. |
| C | A significantly slight horizontal streak is recognized at a pitch of the developer carrying member in the first and the second halftone images, but no horizontal streak is recognized in the third and subsequent halftone images. |
| D | A slight horizontal streak is recognized at a pitch of the developer carrying member in the first halftone image, but no horizontal streak is recognized in the second and subsequent halftone images. |
| E | A slight horizontal streak is recognized at a pitch of the developer carrying member in the first and second halftone images, but no horizontal streak is recognized in the third and subsequent halftone images. |
| F | A slight horizontal streak is recognized at a pitch of the developer carrying member in the first to third halftone images, but no horizontal streak is recognized in the fourth and subsequent halftone images. |
| G | A slight horizontal streak is recognized at a pitch of the developer carrying member in the first to fourth halftone images, but no horizontal streak is recognized in the fifth and subsequent halftone images. |
| H | A horizontal streak is recognized at a pitch of the developer carrying member in the first halftone image, but no horizontal streak is recognized in the second and subsequent halftone images. |
| I | A horizontal streak is recognized at a pitch of the developer carrying member in the first and second halftone images, but no horizontal streak is recognized in the third and subsequent halftone images. |

TABLE 3-continued

| Rank | Evaluation criteria |
|---|---|
| J | A slight horizontal streak is recognized at a pitch of the developer carrying member in the first to 20th halftone images, and a slight horizontal streak is recognized at random in the 21st and subsequent halftone images. |
| K | A slight horizontal streak is recognized at a pitch of the developer carrying member in all halftone images. |
| L | A horizontal streak is recognized at a pitch of the developer carrying member in all halftone images. |
| M | A plurality of horizontal streaks are recognized at a pitch of the developer carrying member and other pitches in all halftone images. |

Comparative Example 6

A comparative photosensitive member 3 was produced in the same manner as the photosensitive member 16 except that the support was changed to a support having an outer diameter of 30 mm and a length of 254 mm, whose surface had been roughly cut.

A reconstructed machine of a laser beam printer (product name: MS812, manufactured by Lexmark) was used as an electrophotographic image forming apparatus. The electrophotographic image forming apparatus was reconstructed so as to be capable of adjusting the charging potential and the image exposure light amount at the time of solid black output, and evaluation was performed at a constant charging potential (−600 V) and a constant exposure potential (−150 V).

First, the electrophotographic image forming apparatus and the photosensitive member were left to stand for 24 hours or more under an environment having a temperature of 23° C. and a humidity of 50% RH. Then, the comparative photosensitive member 3 was mounted on a process cartridge of a cyan color of the electrophotographic image forming apparatus.

A halftone image (image in which a line with a width of 1 dot is drawn at an interval of 2 dots in a direction perpendicular to a rotation direction of the electrophotographic photosensitive member) was output continuously on 100 sheets of $A_4$-size plain paper under the condition of the rotation speed ratio D1/D2 of 143%.

The evaluation was performed by visually observing the 100 sheets based on ranks shown in Table 3. The results are shown in Table 4.

TABLE 4

| | Photosensitive member | Structural formula (1) or structural formula (2) | S1/S2 | D1/D2 % | Process speed sheets per min | Developer | Rank |
|---|---|---|---|---|---|---|---|
| Comparative Example 6 | Comparative photosensitive member 3 | Present | 0.258 | 143 | 66 | Developer 3 | K |

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-032148, filed Mar. 1, 2021, which is hereby incorporated by reference herein in its entirety.

What is claimed is:

1. An electrophotographic image forming apparatus comprising:

an electrophotographic photosensitive member, which is rotatable and comprises a protective layer serving as a surface layer;

a charging unit configured to form a charging portion in contact with the electrophotographic photosensitive member, and to charge a surface of the electrophotographic photosensitive member in the charging portion;

an exposing unit configured to irradiate the surface of the electrophotographic photosensitive member with exposure light; and a developer carrying member configured to supply a developer which is charged to the surface of the electrophotographic photosensitive member, wherein the protective layer contains a cured product of a composition containing a monomer having a polymerizable functional group, and the cured product contains at least an aromatic ring and an ester group, in a peak area of a spectrum of the surface of the electrophotographic photosensitive member obtained through measurement by attenuated total reflection Fourier transform infrared spectroscopy using germanium as an internal reflection element and a measurement condition of 45° as an incident angle, when a peak area at from 1,530 $cm^{-1}$ to 1,470 $cm^{-1}$ based on C═C stretching vibration of the aromatic ring is represented by S1, and a peak area at from 1,770 $cm^{-1}$ to 1,700 $cm^{-1}$ based on C═O stretching vibration of the ester group is represented by S2, an area ratio S1/S2 of the S1 to the S2 is 0.10 to 0.27, and a rotation speed ratio D1/D2 of a rotation speed D1 of the developer carrying member to a rotation speed D2 of the electrophotographic photosensitive member is 0.80 to 1.20.

2. The electrophotographic image forming apparatus according to claim 1, wherein the monomer having a polymerizable functional group comprises at least one compound selected from the group consisting of: a compound represented by formula (1); and a compound represented by formula (2):

(1)

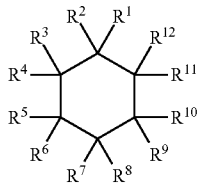

where, in formula (1), at least two of $R^1$, $R^5$, and $R^9$ represent groups each having a (meth)acryloyloxy group, and $R^1$, $R^5$, and $R^9$ that do not represent the groups each having a (meth)acryloyloxy group each represents a hydrogen atom or a methyl group, and $R^2$ to $R^4$, $R^6$ to $R^8$, and $R^{10}$ to $R^{12}$ each represents a hydrogen atom or a methyl group;

(2)

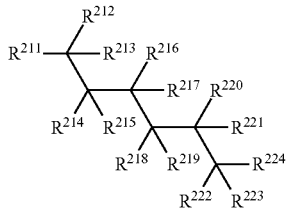

where, in formula (2), $R^{211}$ and $R^{224}$ each represents group having a (meth)acryloyloxy group, and $R^{212}$ to $R^{223}$ each represents a hydrogen atom or a methyl group.

3. The electrophotographic image forming apparatus according to claim 2, wherein the group having a (meth) acryloyloxy group comprises a group represented by one formula selected from the group consisting of formulae (L-1) to (L-5):

L-1

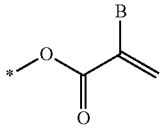

L-2

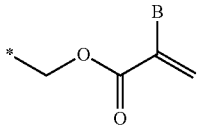

L-3

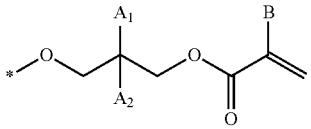

L-4

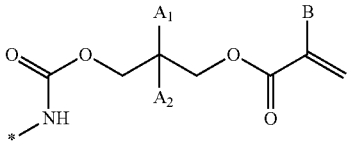

L-5

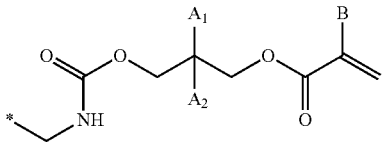

where, in formulae (L-1) to (L-5), * represents a bonding site, $A_1$ and $A_2$ each represents a hydrogen atom, a group represented by formula (L-1), or a group represented by formula (L-2), and B represents a hydrogen atom or a methyl group.

4. The electrophotographic image forming apparatus according to claim 1, wherein the area ratio S1/S2 is 0.14 to 0.17.

5. The electrophotographic image forming apparatus according to claim 1, wherein, in X-ray photoelectron spectroscopy of the surface of the electrophotographic photosensitive member, when a total of a concentration of a silicon element, a concentration of a carbon element, a concentration of an oxygen element, and a concentration of a nitrogen element is set to 100 atomic %, the concentration of the silicon element is 5 to 20 atomic %.

6. The electrophotographic image forming apparatus according to claim 1, wherein the rotation speed ratio D1/D2 is 0.80 to 0.95.

7. The electrophotographic image forming apparatus according to claim 1, wherein the electrophotographic image forming apparatus has a process speed of 60 sheets per min or more.

8. A process cartridge comprising:

an electrophotographic photosensitive member, which is rotatable and comprises a protective layer serving as a surface layer, and a developer carrying member configured to supply a developer which is charged to a surface of the electrophotographic photosensitive member; and at least one unit selected from the group consisting of: a charging unit configured to form a charging portion in contact with the electrophotographic photosensitive member, and to charge the surface in the charging portion; and a cleaning unit configured to clean the surface, the process cartridge integrally supporting the electrophotographic photosensitive member, the developer carrying member, and the at least one unit, and being removably mounted onto a main body of an electrophotographic apparatus, wherein the protective layer contains a cured product of a composition containing a monomer having a polymerizable functional group, and the cured product contains at least an aromatic ring and an ester group, in a peak area of a spectrum of the surface of the electrophotographic photosensitive member obtained through measurement by attenuated total reflection Fourier transform infrared spectroscopy using germanium as an internal reflection element and a measurement condition of 45° as an incident angle, when a peak area based on C═C stretching vibration of the aromatic ring is represented by S1, and a peak area based on C═O stretching vibration of the ester group is represented by S2, an area ratio S1/S2 of the S1 to the S2 is 0.10 to 0.27, and the developer carrying member and the electrophotographic photosensitive member are configured so that a rotation speed ratio D1/D2 of a rotation speed D1 of the developer carrying member to a rotation speed D2 of the electrophotographic photosensitive member satisfies 0.80 to 1.20.

* * * * *